United States Patent [19]

Reese

[11] 4,246,863

[45] Jan. 27, 1981

[54] FLUSHING ASSEMBLY

[76] Inventor: John T. Reese, 406 Buttonwood La., Largo, Fla. 33540

[21] Appl. No.: 31,942

[22] Filed: Apr. 30, 1979

[51] Int. Cl.[3] ..... B08B 3/02; B08B 9/00

[52] U.S. Cl. ..... 440/88; 134/167 R; 440/113

[58] Field of Search ..... 134/166 K, 167 R, 199; 24/243 R, 243 B, 248 R, 248 SA; 115/75, 17, 18, 34

[56] References Cited

U.S. PATENT DOCUMENTS

| | | | |
|---|---|---|---|
| 147,298 | 2/1874 | White | 24/248 SA |
| 3,931,828 | 1/1976 | Lawler | 115/75 |
| 4,065,325 | 12/1977 | Maloney | 134/167 R |

*Primary Examiner*—Trygve M. Blix
*Assistant Examiner*—D. W. Keen
*Attorney, Agent, or Firm*—Arthur W. Fisher, III

[57] ABSTRACT

A flushing assembly of the type used to clean outboard motors by forcing cleaning water through the inlet ports of the outboard motor and comprising a base specifically structured to provide a water inlet in fluid communicating relation to the inlet ports of the motor. The base is structured so as to be capable of being clamped to the motor being cleaned adjacent the inlet ports and further to allow a water supply to be interconnected to the base wherein both the water supply and the adjustment of the base occurs at a location remote from the motor being cleaned so as to facilitate such cleaning when the motor is not readily accessible.

1 Claim, 5 Drawing Figures

FLUSHING ASSEMBLY

BACKGROUND OF THE INVENTION

1. Field of the Invention

This invention relates to a flushing structure capable of being attached to the exterior of an outboard motor immediately adjacent its inlet ports so as to force water therethrough while the motor is running thereby allowing cleansing fluid to run through the motor.

2. Description of the Prior Art

The use of outboard motors on relatively small marine craft and vessels has enjoyed wide popularity for many years. Such motors are used both in certain commercial applications as well as recreational application. In that outboard motors of course an expensive item to initially purchase it is of prime importance to the owner to receive as much use from the motor through a long operable life as possible.

To accomplish long years of operation of outboard motors maintenance of such motors and proper mechanical and preventive and maintenance type services should adequately be performed on the motors. While numerous outboard motors clearly state that internal cleaning utilizing fresh water is not necessary such cleaning services is well known to add to the operable life of an outboard motor especially when such motor is used in a saltwater environment.

In order to accomplish the internal cleaning of such motors the general procedure is to force clean or fresh water in through the cooling inlet ports of the outboard motor. During operation these inlet ports are generally provided to allow intake of water through which the motor is travelling wherein the water is used to cool the engine during operation. By forcing the cleaning water through the engine in this fashion cleansing or removal of saltwater from the working parts of the engine is accomplished.

Numerous prior art devices are in existence and are commercially available which are designed to secure a supply of fresh water to the motor adjacent the inlet port so that such fresh water will be driven through the engine in the manner described above. These devices and/or assemblies take many forms and are generally represented in the following U.S. Pat. Nos. 3,886,889 to Burger; 3,003,456 to Crozier; 3,002,488 to Guhlin; and 2,611,631 to Benson.

While the devices disclosed in each of the patents set forth above are applicable to accomplish forcing of water through the engine for cleaning purposes each generally require the placement of a device on or about the motor. This placement, due to the inherent design of the structure set forth may sometimes become quite inconvenient and possibly dangerous. Cleaning of the outboard motor occurs frequently when the motor is out of the water such as being supported by davits in suspended form above the water in which it usually travels. In such orientation the cleaning devices of the type set forth in the above noted patents must be attached directly to the motors adjacent the inlet ports which requires direct access to the motor itself.

This in turn frequently requires the operator to position himself in the water, or otherwise suspend himself out to the raised or supported motor in somewhat perilous position.

Accordingly, there is a need in the marine industry for a flushing assembly or implement which can be applied to a motor in the proper position irrespective of the motor being disposed in suspended orientation or in its normal position in water connected to the transom of a marine craft or vessel. In addition, such flushing assembly should be capable of efficiently being secured to the motor adjacent the inlet ports thereof in a manner which will allow minimum discomfort of the operator and prevent or make unnecessary the need to position himself in an convenient or even perilous position.

SUMMARY OF THE INVENTION

This invention relates to a flushing assembly of the type used to direct cleaning water through the inlet ports of an outboard motor of the purpose of cleaning the interior working portions thereof. In particular the structure of the subject flushing assembly is such as to have extended parts thereof to allow efficient positioning of the flushing assembly relative to the inlet ports of an outboard motor irrespective if the motor is disposed in its normal working position submerged within water or suspended by davits in a "dry dock" situation.

More specifically the flushing assembly comprises a base means having a water inlet secured to one base plate thereof. A second base plate at least partially defines the base means wherein two base plates are hingedly connected to one another so as to allow pivotal movement of the two base plates relative to one another. Such pivotal movement in turn allows a clamping action to be performed about the portion of the outboard motor associated with the inlet ports. An elongated conduit means serves to interconnect the water outlet with a water inlet disposed, to the elongated nature of the water conduit, at a remote location from the base means. The water inlet has an adapting structure secured thereto so as to allow attachment to a water hose or other conventional water supply. The water outlet is surrounded by a seal means, which is preferably in the form of a water gasket which engages the surface immediately surrounding the inlet port of the outboard motor being cleaned. In such fashion water is forced from the water inlet through the conduit and in direct exposed relation to the inlet ports. Accordingly, once the motor is started the fresh supply of water drawn into the inlet ports from the water outlet travels through the interworkings of the engine or outboard motor thereby causing cleaning and removal of any saltwater or other harmful residue.

A securement means is also provided in movably attached relation to the two base plates of the base means. This securement means at least in part comprises an elongated securement shaft. This elongated shaft has one end movably attached to both base plates and is disposed on opposite sides of the hinged interconnection between the base plates. Accordingly, rotation or otherwise manipulation of the securement shaft allows the space between the base plates to vary thereby allowing the base plates to clamp about the inlet ports of the outboard motor.

The opposite end of the elongated securement shaft is defined in at least in part by a crank handle. Accordingly manipulation of the crank handle at a remote point from the base means causes activation or relative movement of the elongated shaft to the base plates and thereby causes the clamping action as described above.

Accordingly, the location of both the water inlet, being adapted to be attached to a conventional water supply, and the crank handle, used to manipulate the securement means, both at a remote location thereby allows the base means to be effectively positioned by the operator without subjecting himself to perilous positioning during affixation of the base means to the motor or placing himself in an inconvenient location such as in the water itself.

In order to further supporting the flushing assembly a support means and fastening connector may be secured in interconnected relation to the elongated securement shaft and the elongated conduit. Conventional connector may serve as the support connector and be secured by cable, chain, etc. in a manner to at least partially support the flushing assembly during operation and as it is being positioned for securement to the motor being cleaned.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
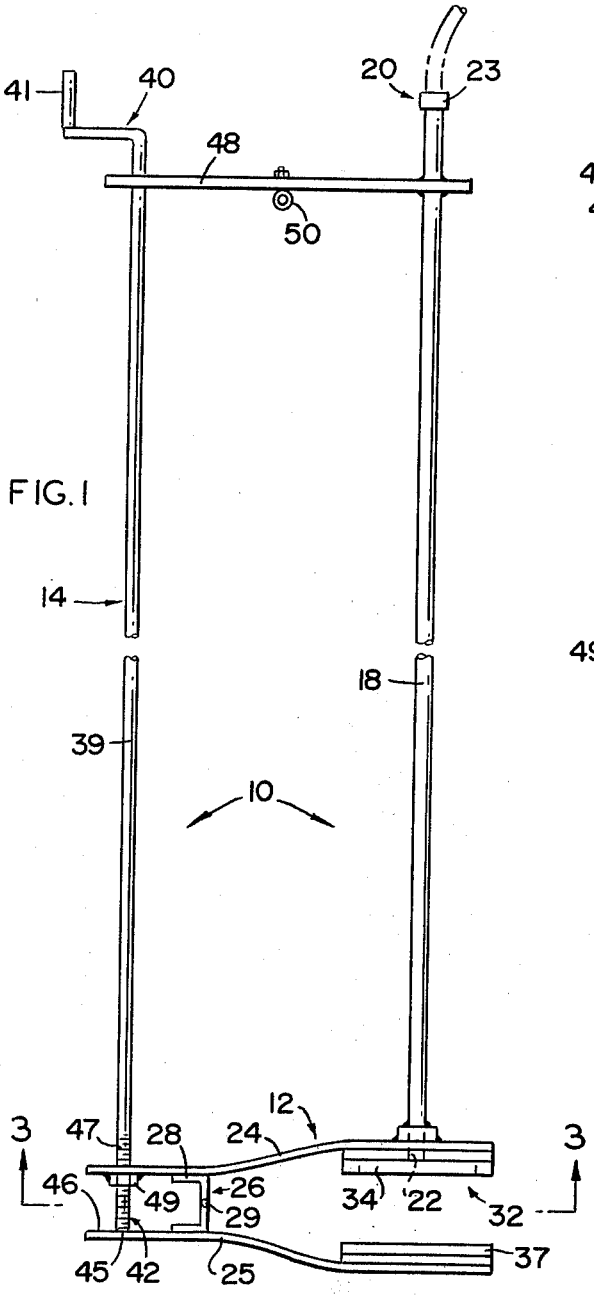
FIG. 1 is a front view of the flushing assembly of the flushing assembly of the present invention.
Figure 2:
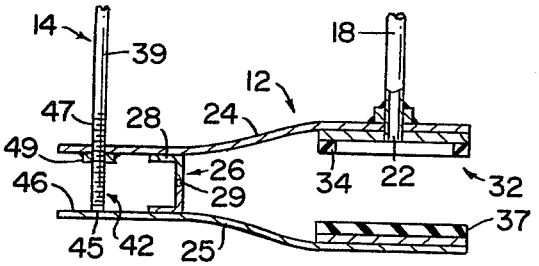
FIG. 2 is a sectional view in partial cutaway of details of the base means of the present invention.
Figure 3:
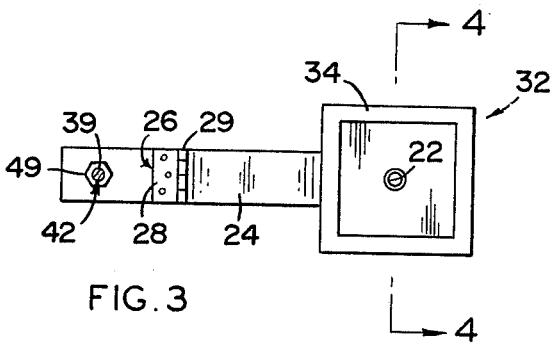
FIG. 3 is a front view of the structural embodiment of FIG. 2.
Figure 4:
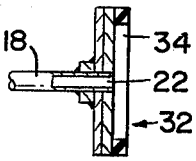
FIG. 4 is a detailed view in partial cutaway of the water outlet means and associated conduit.
Figure 5:
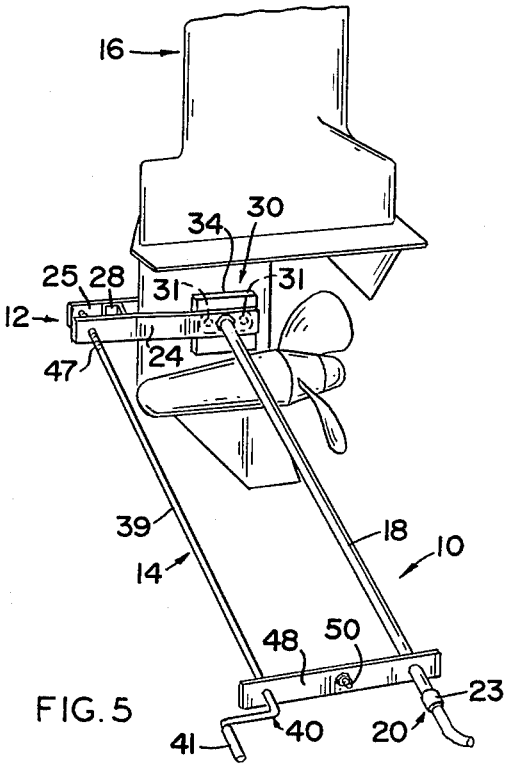
FIG. 5 is a perspective view showing the flushing assembly of the present invention secured in actual operation to an outboard motor assembly.

With reference to FIG. 1 the flushing assembly of the present invention is generally indicated as 10 and comprises a base means generally indicated as 12, and a securement means generally indicated as 14. Water to be used as the cleaning water to be fed to the interior of an outboard motor generally indicated (FIG. 5) as 16 is fed to the base means 12 by means of an elongated water conduit 18. This water conduit serves to interconnect a water inlet generally indicated at 20 and a water outlet generally indicated at 22 on the base means 12. Accordingly, the water inlet comprises an adaptor member 23 specifically designed to be interconnected to a substantially conventional water hose or like so as to force water, from a conventional water supply through the conduit 18 so as to exit from the water outlet 22 and thereby be forced into the inlet ports formed or mounted on the outboard motor 16.

With regard to the base means 12 and as best shown in FIGS. 1 through 4, the base means comprises at least two base plates 24 and 25 pivotally or hingedly connected to one another as at 26 by hinged means 28. Accordingly, each of the plates 24 and 25 may move relative to one another about the pivotal axis 29. This rotational movement causes a selected variance in the spacing between the base plates 24 and 25 for the purpose of clamping portions of the outboard motor 16 therebetween. More specifically with reference to FIG. 5 the portion of the outboard motor 16 generally associated with the inlet ports as at 30 are clamped in covering relation by the base plates 24 and 25. In this orientation each of the inlet ports 31 is covered and further is disposed in direct fluid communication with the water outlet 22.

A seal means 32 is provided in the form of a resilient material gasket 34 disposed in surrounding relation to the water outlet 22. This resilient material gasket 34 serves to engage the outer surface of the outboard motor 16 in surrounding and over covering relation to the inlet ports 31 so as to insure that water coming through conduit 18 is forced directly through the inlet ports to perform the cleaning function in the manner described above.

Further structural features of the subject flushing assembly comprises the existence of a cushion means 37 also formed of resilient material so as to provide proper clamping action and a generally tight fit when positioned about the outboard motor 16 in surrounding relation to the inlet ports 31.

With reference to FIG. 1 the securement means 14 of the present invention comprises an elongated securement shaft 39 having its outward end as at 40 defined substantially into a crank handle 41. Such crank handle is designed to impart rotational movement to the elongated shaft 39 so as to cause separation and/or closing of the base plates 24 and 25 relative to one another. This is accomplished by specific movable interconnection of end 42 of shaft 39 to the base means 12. This connection is accomplished by disposing the furthermost end as at 45 of the shaft 39 into abutting relation with the inner-surface 46 of plate 25. The portion for outer surface adjacent the end 42 of shaft 39 is threaded as at 47. This threaded surface area is rotatably connected in threaded engagement to connector portion 49 of plate 24. Accordingly, rotational movement of shaft 39 by manual manipulation of crank shaft 41 causes variation in the spacing of base plates 24 and 25 in actual operation of the crank handle 41 causing rotation of shaft 39 closes the distance between the correspondingly positioned ends of plates 24 and 25 interconnected to end 42 of shaft 39. This in turn spaces farther apart the oppositely disposed ends of the base plates 24 and 25 which are associated with the seal means 32 and cushion means 37. To the contrary, rotation of the shaft 39 in the opposite direction causes a closing of the ends of the plates 24 and 25 associated with the water inlet thereby causing this portion to clamp firmly about the inlet ports 31 over the portion 30 of the outboard motor 16.

At that this point it should be emphasized that while reference is specifically made to the flushing assembly 10 being used in operation with outboard motor 16, any outboard motor assembly 16 having a properly positioned inlet ports 31 may be cleansed or flushed using the assembly of the present invention. However, it should be emphasized that the outboard motor structure 16 is not per se a part of the present invention.

Additional structural features of the present invention comprise the addition of a support means 48 in the form of a support element extending between and interconnecting the shaft 39 with the elongated conduit 18. Such support means provides additional stability between the shaft 39 and the conduit 18 thereby allowing the ready positioning and manipulation of the entire assembly 10. In addition a support connector 50 is secured to the support element 48 and is generally provided for interconnection with a support chain or cable.

Such a chain or cable is used to aid in the suspension and overall support of the assembly 10 prior to and during affixing the assembly 10 to the outboard motor 16 adjacent and an overlapping or over covering relation to the inlet ports 31.

In an important structural feature of the present invention is the elongated configuration of both of the shaft 39 and the conduit 18. These elements are specifically elongated so as to dispose the water inlet 20 and the adaptor 23 as well as the crank handle 41 in remote location to the base means 12. By virtue of this remotely located extension or extended structural feature, the base means may be readily clamped to the outboard motor 16 in water delivering relation to the inlet ports 31 through handling only of the remote end of the shaft 39 and conduit 18. Similarly the shaft 14 can of course be rotated through manipulation of the crank handle 41 as well as water being supplied through conduit 18 through connection of the adaptor 23 to conventional water supply.

It will thus be seen that the objects set forth above among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A flushing assembly of the type used to direct cleaning water from a remote location to the water intake ports of an outboard motor, said flushing assembly comprising: base means structured and configured to engage the motor adjacent the water intake ports, water outlet ports formed on said base means in communicating disposition with the intake ports, seal means secured to said base means and disposed thereon in substantially surrounding relation to the intake ports wherein said base means is attached to the motor, water inlet means disposed in interconnected flow communicating relation with said water outlet and remote from said base means, securement means mounted on said base means in spaced relation from said water outlet means and structured and disposed to aid in securement of said base means to the outboard motor, said base means comprises at least two base plates disposed in at least partially spaced apart relation to one another by a pivot means disposed in movable interconnection between said base plate and intermediate the ends thereof, said water outlet means and said seal means disposed opposite said pivot means relative to said securement means and said securement means engaging both said plates thereof and disposed to regulate the space therebetween when moved relative thereto, said two base plates movably interconnected to one another, whereby space therebetween may be varied, said base plates structured and dimensioned for clamping engagement with an outboard motor in covering relation to the intake ports thereof, said securement means comprises an elongated shaft having one end disposed in abutting engagement with one of said end plates and threadly engaging the other of said end plates, whereby rotational movement of said elongated shaft regulates distance between inner surfaces of said two base plates, the opposite end of said elongated shaft defining a crank handle disposed in spaced apart, remote relation from said base means, said shaft interconnected to both base plates to allow regulation of the space therebetween, said seal means comprises resilient gasket means mounted on an inner surface of at least one of said base plates in surrounding engagement to said water outlet, said resilient gasket means structured and dimensioned to establish fluid flow between said water inlet and the intake port of the motor on which the base means is mounted, cushion means formed on the inner surface of one of said base plates and substantially oppositely disposed relative to said water outlet means, said cushion means formed from a substantially resilient material, said water outlet means disposable into secure clamping relation to the motor adjacent the intake port thereof upon activation of said securement means, elongated conduit means disposed in liquid communicating relation between said water outlet and said water inlet means and extending outwardly from said base means, said water inlet means being disposed at a remote location from said base means and being structured for attachment with a water supply, whereby cleaning water may be supplied to said base means and inlet ports of the motor to which it is attached at a location remote from the motor being cleaned, both said elongated shaft of said securement means and said elongated conduit extend outwardly from said base means and substantially in the same direction and terminating at a substantially equally distant location from the base means, said elongated shaft and said elongated conduit are disposed in substantially parallel relation to one another, said water outlet and said crank handle disposed in spaced apart and substantially parallel relation to one another, said water outlet and said crank handle disposed in spaced apart and substantially adjacent relation to one another at a location remote from said base means and support means disposed in interconnecting relation between said elongated shaft and elongated conduit adjacent said crank handle and including attachment means secured thereto, said support means disposable in positioning and supporting relation to the rest of said flushing assembly.

* * * * *